US006953490B2

(12) United States Patent
Bush

(10) Patent No.: US 6,953,490 B2
(45) Date of Patent: Oct. 11, 2005

(54) IN-LINE OIL SEPARATOR

(75) Inventor: James W. Bush, Skaneateles, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/319,965

(22) Filed: Dec. 16, 2002

(65) Prior Publication Data

US 2004/0112021 A1 Jun. 17, 2004

(51) Int. Cl.[7] ..... B01D 45/04

(52) U.S. Cl. ..... 55/396; 55/414; 55/417; 55/DIG. 17; 415/169.2; 415/169.3; 418/55.6; 418/DIG. 1

(58) Field of Search ..... 55/396, 391, 414, 55/417, DIG. 17; 415/169.2, 169.3, 169.4; 96/360; 418/55.6, DIG. 1

(56) References Cited

U.S. PATENT DOCUMENTS

| | | | | | |
|---|---|---|---|---|---|
| 767,721 | A | * | 8/1904 | Swartwout | 55/396 |
| 1,933,588 | A | * | 11/1933 | Hawley | 55/396 |
| 1,955,465 | A | * | 4/1934 | Lissman | 55/396 |
| 2,209,339 | A | * | 7/1940 | Knight | 55/417 X |
| 2,806,550 | A | * | 9/1957 | Westlin | 55/396 |
| 2,847,087 | A | * | 8/1958 | Johnson | 55/396 |
| 3,576,132 | A | * | 4/1971 | Kotoc | 55/396 X |
| 4,057,075 | A | * | 11/1977 | Muschelknautz et al. | 55/396 X |
| 4,985,058 | A | * | 1/1991 | Prinsloo et al. | 55/396 X |
| 5,800,582 | A | * | 9/1998 | Palmer et al. | 96/360 X |
| 6,080,228 | A | * | 6/2000 | Okada et al. | 55/396 X |
| 6,083,291 | A | * | 7/2000 | Okada et al. | 55/396 X |
| 6,109,902 | A | * | 8/2000 | Goris et al. | 418/DIG. 1 |
| 6,183,526 | B1 | * | 2/2001 | Suzuki | 55/417 X |
| 6,524,373 | B2 | * | 2/2003 | Afeiche et al. | 55/396 X |
| 2003/0033791 | A1 | * | 2/2003 | Elliott | 55/396 |

FOREIGN PATENT DOCUMENTS

| | | |
|---|---|---|
| DE | 1 172 798 | 6/1984 |
| EP | 0 843 093 | 5/1998 |
| EP | 0 867 618 | 9/1998 |
| FR | 1 524 351 | 5/1969 |
| FR | 1 573 527 | 7/1969 |
| GB | 638 315 | 6/1950 |
| JP | 11-132145 | 5/1999 |

* cited by examiner

*Primary Examiner*—Richard L. Chiesa
(74) *Attorney, Agent, or Firm*—Bryan Rockwell

(57) ABSTRACT

An oil separator for use in a compressor for separating oil from refrigerant. The separator includes a discharge line having an inner surface, a structure in the discharge line forming an inlet and an outlet within the discharge line, wherein the inlet has a wider diameter than the outlet; and a design for preventing oil from exiting the outlet and means for directing the oil out of the discharge line. In one embodiment, the structure is a substantially circular wall, and wherein the design for preventing is the shape of the wall and relative orientation of the wall to the discharge line. In one embodiment, the relative orientation is such that the discharge line has a flow direction with a horizontal component of orientation and the wall has a vertical component of orientation relative the horizontal component.

11 Claims, 1 Drawing Sheet

IN-LINE OIL SEPARATOR

TECHNICAL FIELD

This invention is directed to separation of oil from refrigerant in compressors, and more particularly, the separation of oil from refrigerant at the discharge end of a screw compressor.

BACKGROUND OF THE INVENTION

Screw or helical compressors are commonly used in air conditioning applications to compress refrigerant as part of the refrigeration cycle. Screw compressors are composed of meshing screw or helical rotors. While two rotor configurations are the most common design, screw compressors are also known in the art having three, or more, rotors housed in respective overlapping bores so as to co-act in pairs. The rotors of a typical screw compressor are mounted in bearings at each end in housing end plates at the inlet and discharge side. Refrigerant is compressed by the screw rotors toward the discharge side and discharged through ports and into a discharge line.

In normal applications, oil becomes entrained in the refrigerant as a result of the need to lubricate the screw compressor bearings and rotors while the refrigerant passes through and is compressed, and accordingly, needs to be removed after discharge before progressing through the rest of the refrigeration or air conditioning cycle. Accordingly, the combined oil and refrigerant mixture is carried through the compression cycle and then discharged into an oil separator where the oil is removed from the refrigerant. From the oil separator, the refrigerant flows to the condenser.

Oil separators are generally of two types, vertical or horizontal. Horizontal oil separators are usually cylindrical with an inlet at one end. In a horizontal separator, the combined oil and refrigerant mix enters through the inlet. The mixture is directed against the inner surfaces of the separator so that the oil droplets impinge on the surfaces and collect there. Under the influence of the flow and gravity, the oil tends to collect at a particular portion near the bottom of the separator where it is removed through a drain. Optionally, mesh separators or baffles may be used to increase the impingement surface on which oil collects. The refrigerant then exits from the upper portion of the separator above the oil collection area.

SUMMARY OF THE INVENTION

It is an object of this invention to provide an improved oil separation device for use with a screw compressor.

It is another object of this invention to provide a simple but effective oil separation device for use in the discharge line of a screw compressor.

It is yet another object of this invention to provide an oil separation device using the discharge line and gravity as a means for achieving separation.

It is yet another object of the present invention to provide an oil separation device with a simple and inexpensive design.

These objects, and others as will become apparent hereinafter, are accomplished by the present invention that includes an oil separator for use in a compressor for separating oil from refrigerant. The separator includes a discharge line having an inner surface, a structure in the discharge line forming an inlet and an outlet within the discharge line, wherein the inlet has a wider diameter than the outlet; and a design for preventing oil from exiting the outlet and means for directing the oil out of the discharge line. In one embodiment, the structure is a substantially circular wall, and wherein the design for preventing is the shape of the wall and relative orientation of the wall to the discharge line. In one embodiment, the relative orientation is such that the discharge line has a flow direction with a horizontal component of orientation and the wall has a vertical component of orientation relative the horizontal component.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
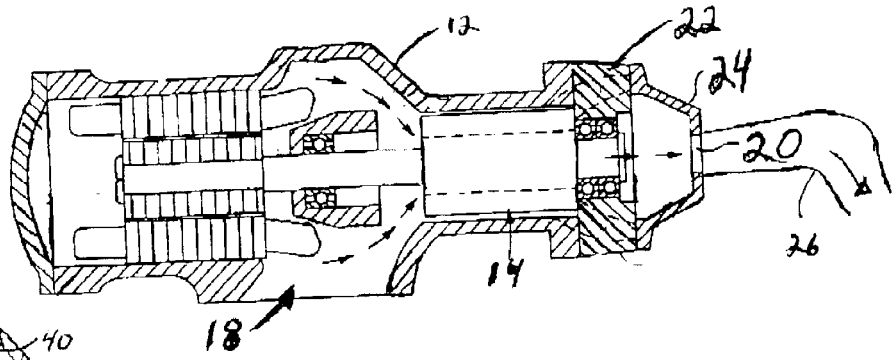
FIG. 1 is a simplified schematic view of a screw compressor showing the discharge end and connections to the discharge line.

Referring now to the drawings in detail there is shown in FIG. 1 a schematic cross-sectional view of a screw compressor. The screw compressor includes a housing 12, intermeshing rotors 14, refrigerant inlet 18 and discharge 20, including a discharge plate 22 and discharge housing 24 that is connected with a discharge line 26. In operation, assuming one of rotors 14 to be the driving rotor, rotor 14 rotates engaging the other rotor, causing its rotation. The co-action of rotating rotors 14 draws refrigerant gas via suction inlet 18 into the grooves of rotors 14 that engage to trap and compress volumes of gas and deliver hot compressed refrigerant gas to discharge port 20.

Figure 2:
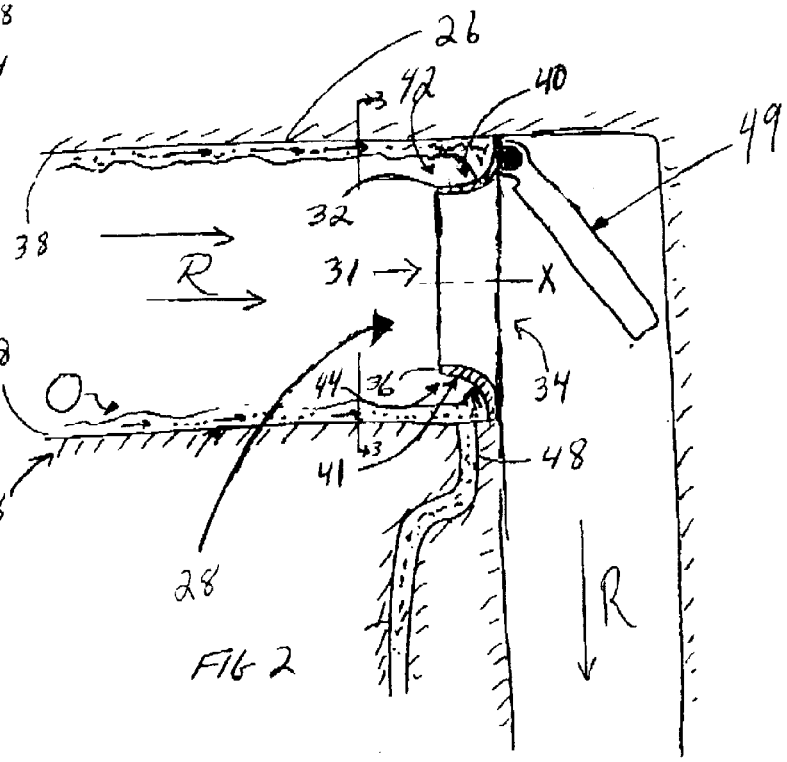
FIG. 2 is a cross-sectional view of the oil separator, showing the oil separation design of the present invention.

The oil separator 28 of the present invention is designed to be located in the discharge tube 26, as shown in FIG. 2. Oil separator 28 includes an oil dam 30, check valve 49, and oil return 48. As compressed gaseous refrigerant is expelled from discharge 20 to discharge tube 26, oil separator 28 functions to remove oil from the refrigerant prior to moving to the condenser.

Figure 3:
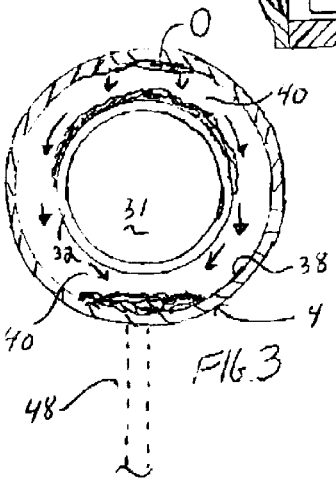
FIG. 3 is a cross-sectional view taken along line 3—3 of FIG. 2, showing the oil flow downward over the separator.

Accordingly, oil separator 28 is preferably circular in shape, having a central opening with an inlet 31, with walls 32 forming the opening and extending on a curvilinear basis axially and radially away from the inlet 31 to the outlet 34. As shown the horizontal axis X of the separator 28 extends in the same direction as refrigerant R flow, shown by the arrows. Wall 32 extends from face 36 of separator 28 to the inner walls of discharge line 26 and the oil separator 28 is secured to the wall via a known method such as welding. As refrigerant vapor flows through discharge line 26, oil O attaches to the walls 38 thereof and flows in the direction of the vapor flow. Accordingly, the oil O flows along the wall 38 until it reaches dam portion 40 formed between walls 32 and 38, and is thus prevented from further travel via dam 40 while the refrigerant vapor with much oil removed continues to travel through the refrigeration or air-conditioning cycle. On the upper end 42 of separator 28 oil gathers in dam portion 40 and, as shown in FIG. 3 by the arrows, flows over the outer surface of wall 32 and the inner surface of wall 38, down under the force of Gravity G, to lower end 44. Along the lower end 46 of wall 38, oil O flows to lower dam portion 41 formed between walls 32 and 38 and accumulates at lower dam portion 41 in the vicinity of an oil return 48 (shown in FIG. 4 by dotted lines). Oil return 48 extends downward, vertically using gravity G to transport the excess oil flowing from the dam 40 of separator 28. Oil is transported via return 48 for reclaim to a sump for use for lubricating the screw bearings and rotors. Optionally, a pressure difference between the separator and the sump may also be used in addition to gravity G or separately from gravity G to transport the oil via return 48. Oil separator 28 optionally includes a check valve 49, as shown in FIG. 2, hinged at the upper portion of the outlet 34 to prevent reverse flow of refrigerant back through the compressor when the system is not in operation.

Figure 4:
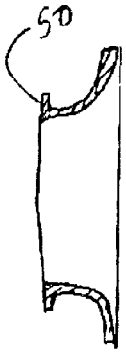
FIG. 4 is an alternative embodiment of the oil separator shown in FIG. 2.

Optionally wall 32 could include a lip portion 50, as shown in FIG. 4 for assistance in further retaining oil flow over the exterior of wall 32. Also, it is not a requirement that the dam have an entirely vertical orientation; there should be a vertical component of the separator orientation to achieve flow down and to a return line through the influence of gravity but angular orientation will achieve the required results as necessitated by the system and discharge piping design.

Although preferred embodiments of the present invention have been illustrated and described, other changes will occur to those skilled in the art. It is therefore intended that the scope of the present invention is to be limited only by the scope of the appended claims.

What is claimed is:

1. An oil separator for use in a compressor for separating oil from refrigerant, comprising:

a screw compressor including a housing, intermeshing rotors, a refrigerant inlet, a refrigerant discharge, and a discharge housing connected to a discharge line;

said discharge line having an inner surface;

a substantially circular wall structure in said discharge line forming an inlet and an outlet within said discharge line, wherein said inlet has a narrower diameter than said outlet;

means for preventing oil from exiting said outlet, said means for preventing comprising the shape of said wall and the relative orientation of said wall to said discharge line, wherein said relative orientation comprises said discharge line having a flow direction with a horizontal component of orientation and said wall having a vertical component of orientation relative said horizontal component, and wherein said shape comprises said wall forming a circular periphery and having a curvilinear surface; and means for directing said oil out of said discharge line.

2. The oil separator according to claim 1, wherein said outlet has a first periphery formed by said wall, said first periphery equal in size and sealingly attached to said inner surface of said discharge line.

3. The oil separator according to claim 2, wherein said inlet has a second periphery formed by said wall, said means for preventing comprising a middle portion of said wall connecting said first and said second peripheries, said middle portion forming a barrier to oil flow.

4. The oil separator according to claim 3, wherein said middle portion is curvilinear in shape.

5. The oil separator according to claim 4, wherein said orientation comprises said wall having a vertical component of orientation such that oil flows downward over said wall away from said inlet.

6. The oil separator according to claim 1, further comprising means for removing oil from within said discharge line.

7. The oil separator according to claim 6, wherein said discharge line is oriented such that flow there through has a horizontal component, wherein said means for removing comprises an oil return having a vertical component of orientation relative to flow through said discharge line.

8. The oil separator according to claim 7, wherein said structure is a substantially circular wall, said wall having a vertical component of orientation relative said horizontal component.

9. The oil separator according to claim 8, wherein said oil return is substantially aligned with said wall such that under the influence of said vertical component and gravity, oil flows over said wall and into said oil return.

10. The oil separator according to claim 3, wherein said wall further includes means for stopping oil from flowing over said second periphery.

11. The oil separator according to claim 10, wherein said means for stopping comprises a lip extending from said wall.

* * * * *